US005505375A

United States Patent [19]

Sato et al.

[11] Patent Number: 5,505,375

[45] Date of Patent: Apr. 9, 1996

[54] WRAPPED ARTICLE

[75] Inventors: Makoto Sato, Kanagawa; Satoshi Aramaki, Tokyo; Takayoshi Ose, Kanagawa, all of Japan

[73] Assignee: Fuji Photo Film Co., Ltd., Kanagawa, Japan

[21] Appl. No.: 251,263

[22] Filed: May 31, 1994

[30] Foreign Application Priority Data

May 31, 1993 [JP] Japan ..... 5-028785 U
Sep. 24, 1993 [JP] Japan ..... 5-051732 U

[51] Int. Cl.[6] ..... B65D 17/00

[52] U.S. Cl. ..... 229/237; 229/238; 206/387.1

[58] Field of Search ..... 206/387.1, 459.5; 229/208, 237, 238, 925; 383/211

[56] References Cited

U.S. PATENT DOCUMENTS

| | | | |
|---|---|---|---|
| 2,213,758 | 9/1940 | Eichberg et al. . | |
| 3,263,807 | 8/1966 | Fingerhut | 229/238 |
| 3,343,746 | 9/1967 | Shiffman | 229/237 |
| 4,192,420 | 3/1980 | Worrell, Sr. et al. | 383/211 |
| 5,011,014 | 4/1991 | Borck et al. | 206/387.1 |
| 5,423,423 | 6/1995 | Sato et al. | 206/387.1 |

FOREIGN PATENT DOCUMENTS

| | | | |
|---|---|---|---|
| 0432028 | 6/1991 | European Pat. Off. . | |
| 2847161 | 5/1980 | Germany . | |
| 9010670 | 10/1990 | Germany . | |
| 3-32066 | 3/1991 | Japan . | |
| 2123376 | 2/1984 | United Kingdom | 206/387.1 |
| 2239854 | 7/1991 | United Kingdom . | |

*Primary Examiner*—David T. Fidei
*Attorney, Agent, or Firm*—Sughrue, Mion, Zinn, Macpeak & Seas

[57] ABSTRACT

The outer surface of an article is covered with a wrapping film, and both ends of the wrapping film are lap-welded by heating, so that a body seal section is created. An unbonded part is formed on the periphery of the edge of an upper overlapping film of the wrapping film along the marginal line of the same. This unbonded part extends between the marginal line of the upper overlapping film and the edge of the body seal section. A slit is formed in the vicinity of the unbonded part at right angles to the marginal line of the upper overlapping film. A weakly bonded part, where the upper overlapping film and the lower overlapping film are weakly bonded to each other, is formed to be adjacent to the opposite side of the unbonded part of the body seal section relative to the slit, and extends from that side of the unbonded part to a predetermined length along a marginal line of the upper overlapping film.

17 Claims, 8 Drawing Sheets

WRAPPED ARTICLE

BACKGROUND OF THE INVENTION

1. Field of the Invention

This invention relates to an article wrapped with a wrapping film, and more particularly to a wrapped article, and a method for wrapping same in such a form that a wrapping film is attached in close contact with an object to be wrapped; for example, a wrapped article which contains one or a number of objects such as a magnetic tape cassette housed in a case.

2. Description of the Prior Art

Among various types of recent commodities arranged in a shop, in the case of relatively small products having a regular shape such as a magnetic tape cassette, the product is wrapped with a transparent or translucent wrapping film coated with cellophane, polyethylene, polypropylene, polyvinylchloride, polyvinylidenechloride, or the like, in order to protect the product from dust or moisture and so maintain a good appearance. These magnetic tape cassettes are shipped as a wrapped article or displayed in the shop as one of packages to be sold en block in which an appropriate number of goods are collectively packed.

As a matter of course, when an article (a product) wrapped in this type of wrapping film is used, it is necessary to remove this wrapping film. In most cases, as shown in FIG. 17, a tearing tape 2 is formed inside the wrapping film, and a constitution for facilitating the removal of the film from an article 10 is generally adopted.

In other words, this tearing tape 2 allows a wrapping film 1 to be appropriately split and separated by pulling an exposed end 2*a* of the tape 2. Slits 3 are formed along this tearing tape in the vicinity of the exposed end 2*a*, thereby facilitating the removal of the tape. By means of such a constitution, the wrapping film 1 can be split along the tearing tape 2 from the end 2*a*. As a result of this, the wrapping film 1 is split up completely or separated in two.

A wrapping method which is generally called shrink-wrap is widely used for such a wrapping film. In this shrink-wrap, when a wrapping film is attached to an article to be wrapped (i.e. a product), the product is enclosed in the wrapping film while the film is appropriately stretched or heated to a suitable temperature in accordance with the material of the film. The wrapping film is tightly attached onto the surface of the product because of a contracting action of the film, so that the product is enclosed giving it a good appearance. Such tight attachment of the film to the product involves a laborious removal action to open the film. Conventionally, several measures are taken to overcome the drawback in the prior art by, for example, forming the tearing tape as mentioned above. This tearing tape was a very effective means.

However, in order to form a tearing tape inside a wrapping film, machines and processes which are dedicated to producing the tearing tape become necessary. In addition, in view of its function, the tearing tape must be sturdier than the wrapping film, and this tearing tape adds to the cost.

Moreover, although it depends on the position of the tearing tape, when the tearing tape is disposed as shown in FIG. 17, a smaller part "a" of the film remaining after the film has been split by the tearing tape is easy to remove. On the other hand, a larger remaining film "b" involves a very laborious removal action in order to get at the actual content.

For this reason, another type of wrapping film has been put forward, for example, in Japanese Unexamined Utility Model Publication No. 3(1991)-32066, wherein a weakly bonded part which is readily peeled off is formed in a body seal section where both edges of a wrapping film overlap each other and are bonded together. The part of the film that remains after the wrapping film has been torn off with a tearing tape can be readily peeled off by widely removing it from this weakly bonded part.

However, the wrapping film put forward in Japanese Unexamined Utility Model Publication No. 3(1991)-32066 still needs the tearing tape, and hence machines and processes which are dedicated to producing a tearing tape are still necessary, thereby adding to the cost. In order to peel off the wrapping film, two steps of actions such as the tearing of the tearing tape and the removal of the weakly bonded part are necessary, and hence the removal action of the wrapping film becomes laborious.

SUMMARY OF THE INVENTION

In view of the foregoing observations, the primary object of this invention is to provide a wrapped article which requires neither special machines nor members; and which enables easy removal of a wrapping film and access to an article enclosed in the wrapping film by widely tearing off the wrapping film with a single action when the film is opened.

To this end, according to a first aspect of the present invention, there is provided a wrapped article including an article to be wrapped whose outer surface is covered with a wrapping film and a body seal section created by making ends of the wrapping film overlap with each other and bonding them together comprising:

an unbonded part formed along the periphery of an upper wrapping film of the wrapping film in such a way that the unbonded part is not adhered to a lower wrapping film of the wrapping film;

a slit formed in the upper wrapping film in the vicinity of the unbonded part at right angles or an inclined angle to the edge of the upper wrapping film; and a weakly bonded part which is weakly bonded to the lower wrapping film and extends from the opposite side of the unbonded part relative to the slit to a predetermined length along the periphery of the upper wrapping film.

Here, the expression "the slit is formed in the vicinity of the unbonded part" used herein means that the slit is formed without contact with the unbonded part and is formed at a position slightly away from the unbonded part (preferably, the slit should be spaced 2–3 mm away from the unbonded part).

In one preferred mode, two opening sections, each consisting of the unbonded part, the slit and the weakly bonded part may be formed while the weakly bonded parts thereof face inward and are opposite to each other.

In this case, the expression "the weakly bonded parts thereof face inward and are opposite to each other" covers both cases: namely, a case in which the weakly bonded parts of two opening sections are formed apart from each other; and a case in which two weakly bonded parts are common to the opening sections.

According to the wrapped article of this invention, the unbonded part may be provided with a mark to make it clearly distinctive. Alternatively, a mark to indicate an opening direction may be formed in the unbonded part or in the vicinity of the same.

In the wrapped article according to the present invention, the end of the unbonded part is held with fingers or picked up with a fingernail, and this edge is pulled in a direction which is substantially orthogonal to the body seal section. Then, the wrapping film is torn up from the slit, and the weakly bonded part of the body seal section is peeled off, whereby a split spreads in a direction which is substantially orthogonal to the body seal section. This causes the wrapping film to be widely opened to a much greater extent, and hence the film can be peeled off so that substantially the whole of a wrapped article may be considerably easily uncovered.

It is much more preferable to create two opening sections, each consisting of the unbonded part, the slit and the weakly bonded part, in such a way that the weakly bonded parts thereof face inward and are opposite to each other, whereby the wrapping film can be opened from either of the unbonded parts.

Moreover, in the lower wrapping film, a notch is also created in the vicinity of a position where an imaginary continuation from the slit and the lower wrapping film cross each other. Thereby, after the upper wrapping film has been peeled off, the wrapping film can be opened much wider by peeling the lower wrapping film from the notch, whereby the wrapping film can be peeled off much easier.

Further, marks are provided to make clearly distinctive the position of the unbonded part and a peeling direction, and hence a position from which the wrapping film is peeled off is made much clear, thereby rendering the wrapping film more preferable.

DESCRIPTION OF THE PREFERRED EMBODIMENTS

With reference to the accompanying drawings, preferred embodiments of the present invention will now be described.

First Embodiment

Figure 1:
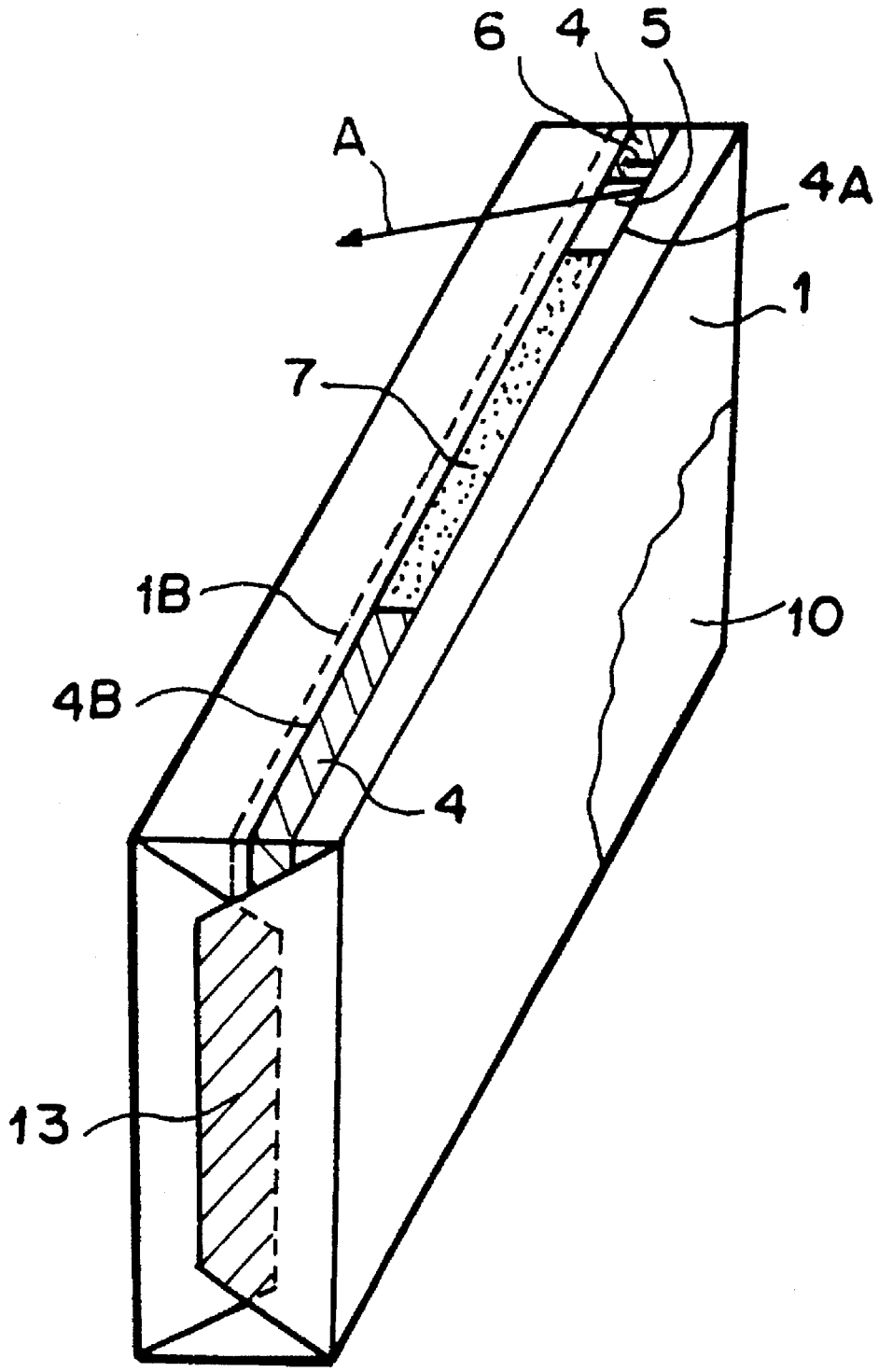
FIG. 1 is schematic representation of a wrapped article according to a first embodiment of this invention.

FIG. 1 is a schematic representation showing a wrapped article according to a first embodiment of the present invention in which a video cassette is to be wrapped.

As shown in FIG. 1, side edges of a wrapping film 1 are overlapped at substantially the center of a narrower side surface of a rectangular parallelopiped article to be wrapped 10 (when it is encased in a housing case), and heated and welded together to constitute a body seal section 4 (this body seal section will be herein designated by a slanting line). Both ends of the body seal section 4 are welded together with the other sides of the film so as to reach a side seal section 13.

The body seal section 4 and the side seal section 13 where the both ends of the wrapping film 1 overlap with each other are welded by appropriate heating after the article to be wrapped 10 has been wrapped.

An unbonded part 5 is formed on the periphery of the body seal section 4, i.e. partially along a marginal line 4A of an upper overlapping film of the wrapping film 1 at least between the marginal line 4A and a marginal line 1B of a lower overlapping film of the wrapping film 1. Here, as a matter of course, the unbonded part 5 may be formed over the whole area between the edges 4A and 4B of the body seal section 4 as shown in FIG. 1. The length of the unbonded part 5 along the marginal line 4A should preferably be set to 10 to 50 mm but most preferably be set to 20 mm or thereabouts. The unbonded part 5 can be formed by printing, in ink which prevents heat sealing, an area of the back surface of the upper overlapping film 1 which corresponds to the unbonded part 5. At least one slit 6 is formed at right angles to the marginal line 4A of the upper overlapping film of the film 1 in the vicinity of the unbonded part 5. The slit 6 should preferably be spaced 2–3 mm apart from the edge of the unbonded part 5 that is nearest to the slit. A weakly bonded part 7, where the upper overlapping film is weakly bonded to the lower overlapping film, is formed on the opposite side of the unbonded part 5 relative to the slit 6, and extends to a predetermined length along the marginal line 4A of the upper overlapping film of the film 1.

Figure 15:
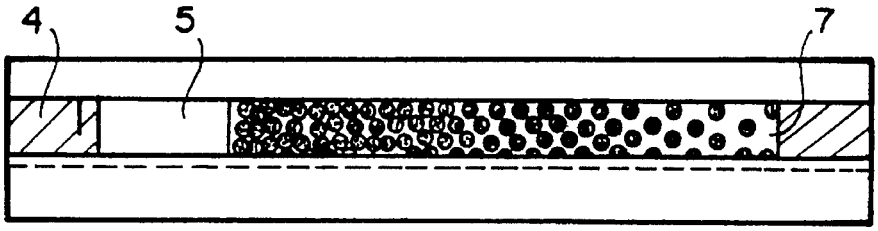
FIG. 15 is a schematic representation showing another embodiment of a weakly bonded part.
Figure 16:
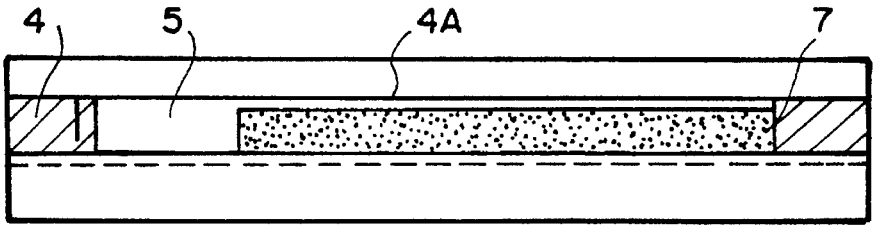
FIG. 16 is a schematic representation showing still another embodiment of the weakly bonded part.
Figure 17:
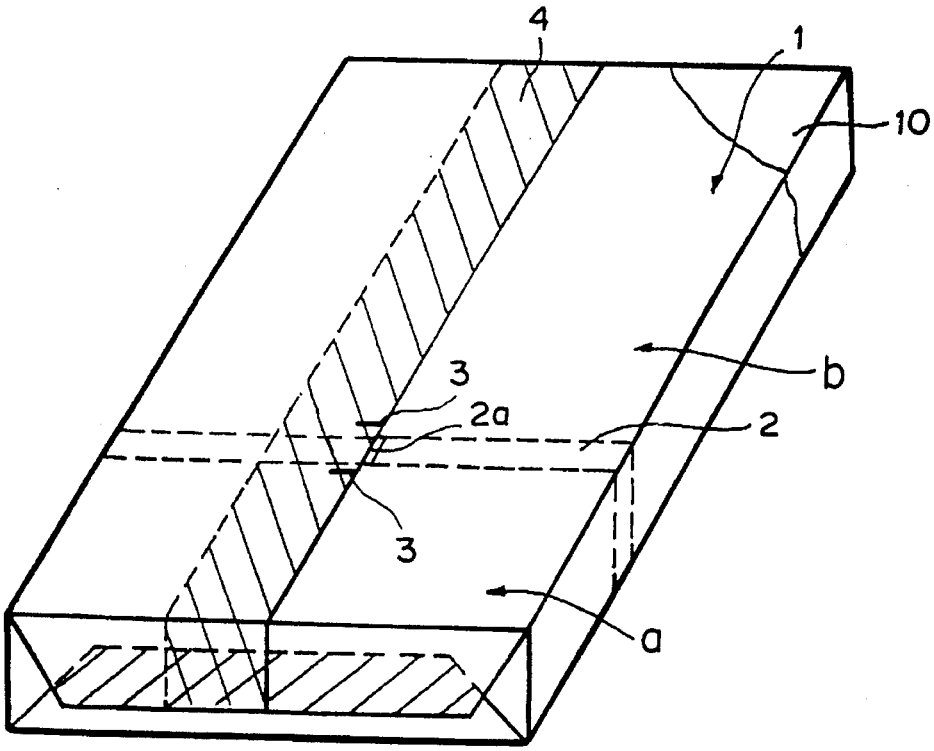
FIG. 17 is a schematic representation showing a conventional wrapped article.

Concerning the weakly bonded part 7, the rear of the area corresponding to the weakly bonded part 7 of the film 1 is printed in ink into half-tone dots or a matrix pattern, and the presence of the ink in the dots or the matrix pattern prevents the body seal section 4 from being entirely welded, whereby the weakly bonded part is produced. In this way, the weakly bonded part 7 is formed by making bonded areas, where the wrapping films are bonded together, and unbonded areas mix with each other. However, it is not necessary to evenly mix the bonded areas with the unbonded areas. For example, as shown in FIG. 15, the density of bonded areas (black areas) within the weakly bonded part 7 along the marginal line 4A may be gradually varied. Alternatively, as shown in FIG. 16, an area close to the marginal line 4A of the upper overlapping area of the wrapping film 1 of the weakly bonded part 7 may be formed into a stripe pattern which is not to be bonded, and bonded areas and unbonded areas may be present over the whole of the weakly bonded part 7. Also, the weakly bonded part 7 can be created by printing an area of the wrapping film 1 corresponding to the weakly bonded part 7 in ink having a weak blocking tendency.

The way the wrapped article of the present invention is peeled off will now be described.

Figure 2:
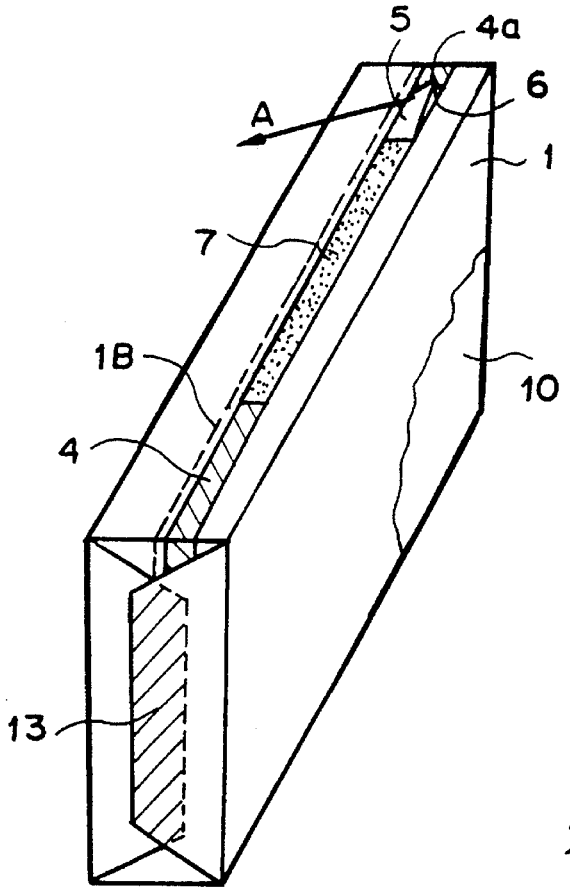
FIG. 2 is a schematic representation of the wrapped article shown in FIG. 1 when an upper film of a body seal section is raised.

Initially, the end of the unbonded part 5 is held with fingers or picked up with a fingernail or the like, and the fingers are moved in the direction of an arrow A as shown in FIG. 1. Thereby, as shown in FIG. 2, the upper overlapping film of the film 1 within the body seal section 4 between the unbonded part 5 and the slit 6 is lifted off from the lower overlapping film of the film 1.

Figure 3:
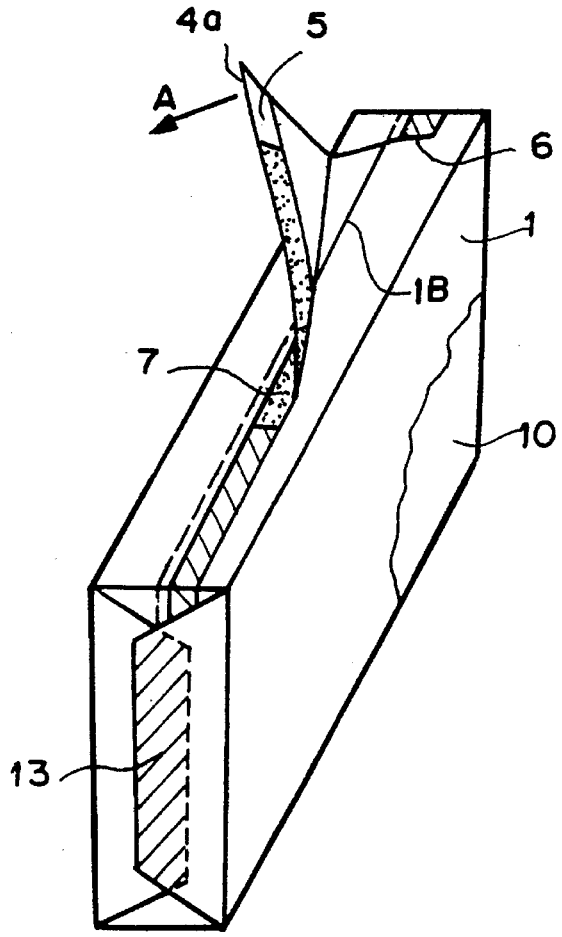
FIG. 3 is a schematic representation of the wrapped article shown in FIG. 1 when the upper film is pulled further.
Figure 4:
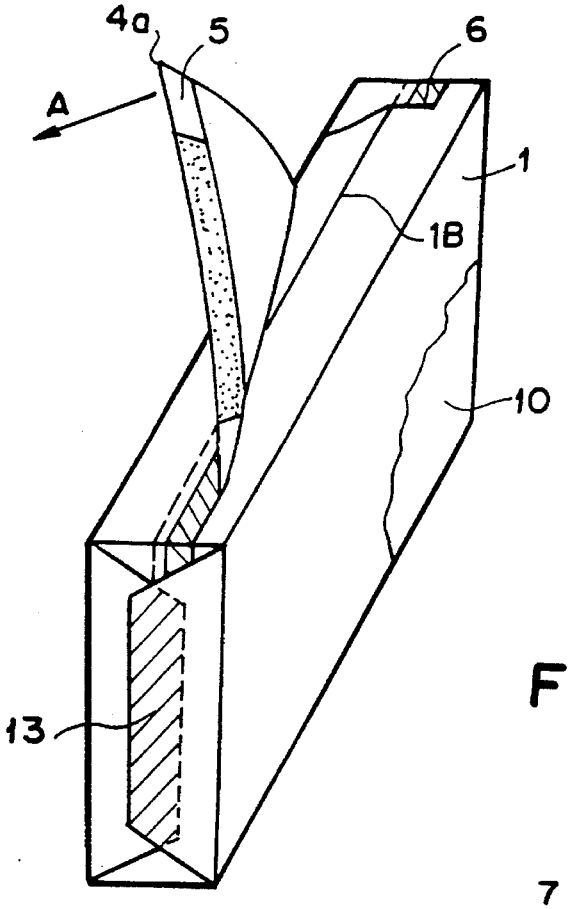
FIG. 4 is a schematic representation of the wrapped article shown in FIG. 1 when the upper film is pulled to a much greater extent.

Then, as shown in FIG. 3, when the end 4*a* of the upper overlapping film of the film 1 thus peeled off is pulled in the A direction, a split developing from the slit 6 spreads; a part of the weakly bonded part 7 is peeled off; and the upper overlapping film of the film 1 is raised from the lower overlapping film of the film 1. Further pulling the end 4*a* of the upper overlapping film of the film 1 in the A direction causes the split from the slit 6 to extend much wider, so that the weakly bonded part 7 is also peeled off much wider. When the end 4*a* of the upper overlapping film of the film 1 thus peeled is pulled in the A direction, the wrapping film 1 is widely opened as shown in FIG. 4.

The split formed by such tearing actions can be caused so that it might continue around the wrapping film 1 by pulling and tearing the end 4*a* of the upper overlapping film of the film 1. Thereby, the wrapping film 1 is widely opened, and hence the film 1 can be peeled off in such a way that substantially the whole of the wrapped article 10 is extremely easily uncovered.

The slit 6 is created in the vicinity of the surface on which the side seal section 13 of the wrapped article 10 is formed. Therefore, a part of the wrapping film 1 remaining on the surface on which the side seal section 13 is formed can be easily taken off by pulling the remaining wrapping film in the direction in which it is removed.

In a conventional wrapped article, when the wrapping film is separated into two by a tearing tape, it is relatively difficult for a user to take off that one of the two subdivisions which is left in a direction opposite to the direction of the tearing of the wrapping film. Compared with this, the wrapped article of this invention allows effective removal operation by a single action, and eliminates the necessity to use the tearing tape, thereby rendering this wrapped article very cost effective.

Second Embodiment

Figure 5:
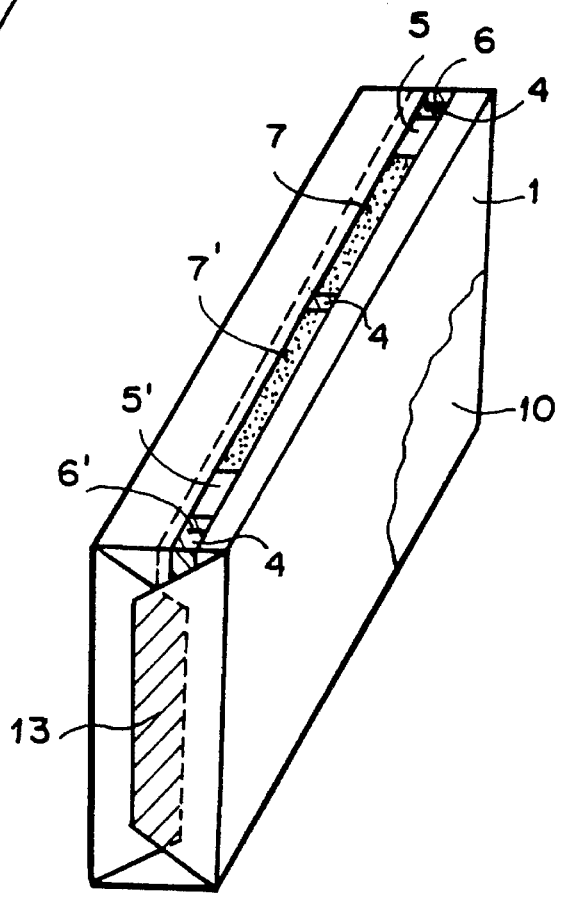
FIG. 5 is a schematic representation of a wrapped article according to a second embodiment of this invention.

A wrapped article according to a second embodiment of the present invention will now be described. FIG. 5 shows a wrapped article of this embodiment. In FIG. 5, a wrapped state of the wrapping film 1, the unbonded part 5, the slit 6 and the weakly bonded part 7 are the same as those of the first embodiment, and hence the explanation thereof will be omitted here for brevity.

In this embodiment, a first opening section consisting of the unbonded part 5, the slit 6 and the weakly bonded part 7 and a second opening section consisting of an unbonded part 5', a slit 6' and a weakly bonded 7' are formed while the weakly bonded parts 7 and 7' face inwardly opposite to each other.

In this way, the use of the first opening section consisting of the unbonded part 5, the slit 6 and the weakly bonded part 7 and the second opening section consisting of the unbonded part 5', the slit 6' and the weakly bonded part 7' allows a user to open the wrapping film 1 from either the unbonded part 5 or the unbonded part 5', and hence the wrapping film 1 can be opened more easily.

Third Embodiment

Figure 6:
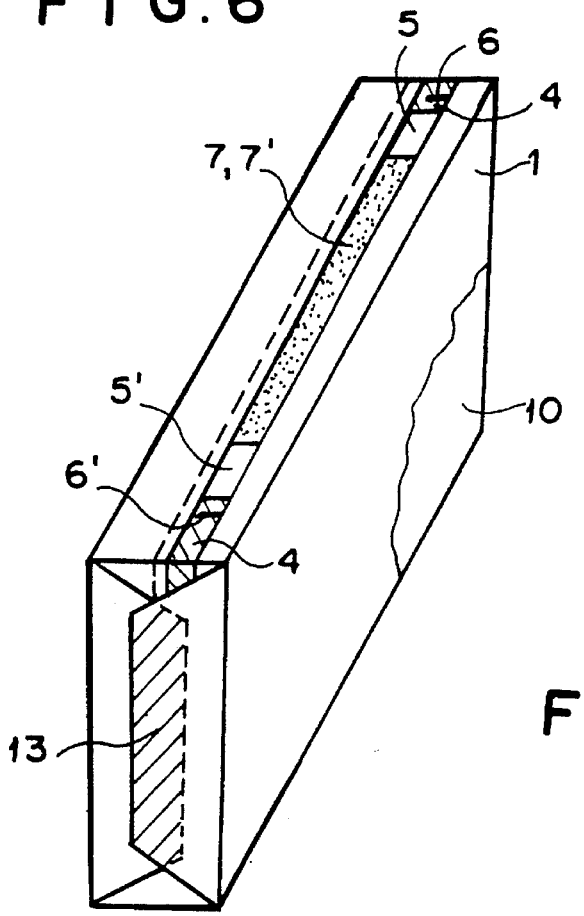
FIG. 6 is a schematic representation of a wrapped article according to a third embodiment of this invention.

Although, in the second embodiment, the first and second opening sections are separately formed, the weakly bonded parts 7 and 7' can be made common to both opening sections as they are exemplified in a third embodiment shown in FIG. 6. Thus, as compared with the second embodiment, the labor required for removing the bonded areas of the weakly bonded parts 7 and 7' can be obviated by making the weakly bonded parts 7 and 7' common in the manner as mentioned above, thereby rendering the wrapped article more preferable.

Fourth Embodiment

Figure 7:
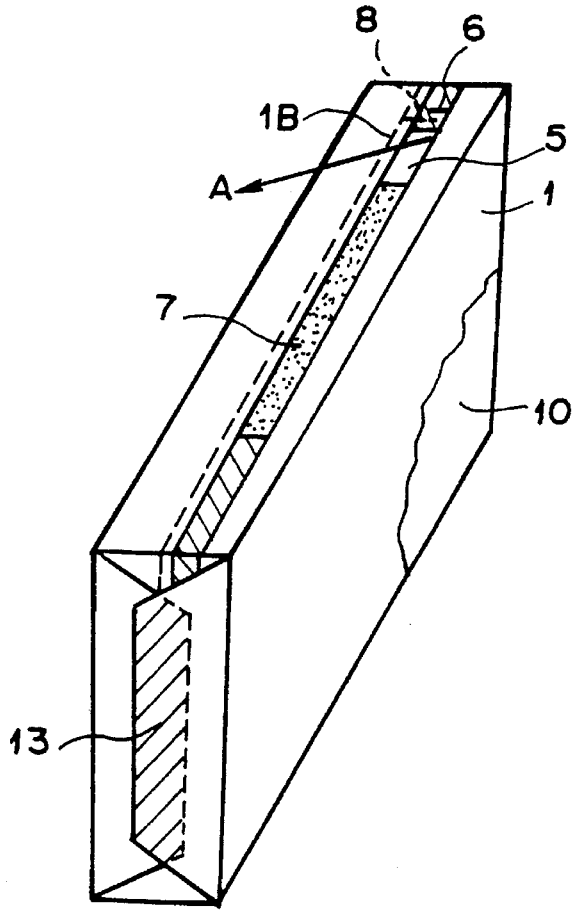
FIG. 7 is a schematic representation of a wrapped article according to a fourth embodiment of this invention.

A wrapped article according to a fourth embodiment of this invention will now be described. FIG. 7 shows a wrapped article of this embodiment. In FIG. 7, a wrapped state of the wrapping film 1, the unbonded part 5, the slit 6 and the weakly bonded part 7 are the same as those shown in the first, second and third embodiments, and hence the explanation thereof will be omitted here for brevity.

In this embodiment, a notch 8 is also formed in the vicinity of the area where the marginal line 1B of the lower overlapping film of the wrapping film 1 and an imaginary continuation from the slit 6 cross each other.

The way the wrapped article of this embodiment is peeled off will now be described.

Figure 8:
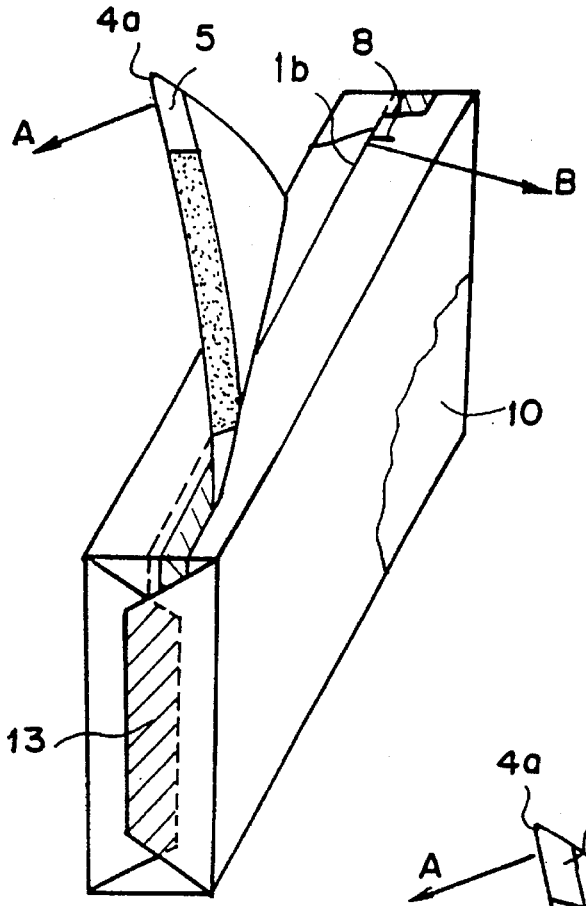
FIG. 8 is a schematic representation of the wrapped article shown in FIG. 7 when an upper film of a body seal section is raised.

Initially, in the same manner as in the first embodiment, the end of the unbonded part 5 is held with fingers or picked up with a fingernail or the like, and the fingers are moved to the direction A as shown in FIG. 7. This causes the wrapping film 1 to split from the slit 6 as shown in FIG. 8, and the split from the slit 6 spreads, and hence a part of the weakly bonded part 7 is peeled off, so that the wrapping film 1 is widely opened.

The split caused by such a tearing action can continue around the wrapping film 1 by pulling the end 4*a* of the upper overlapping film of the wrapping film 1 in the same fashion as in the first embodiment, whereby the wrapping film is torn up. Thus, the wrapping film 1 is widely opened.

Figure 9:
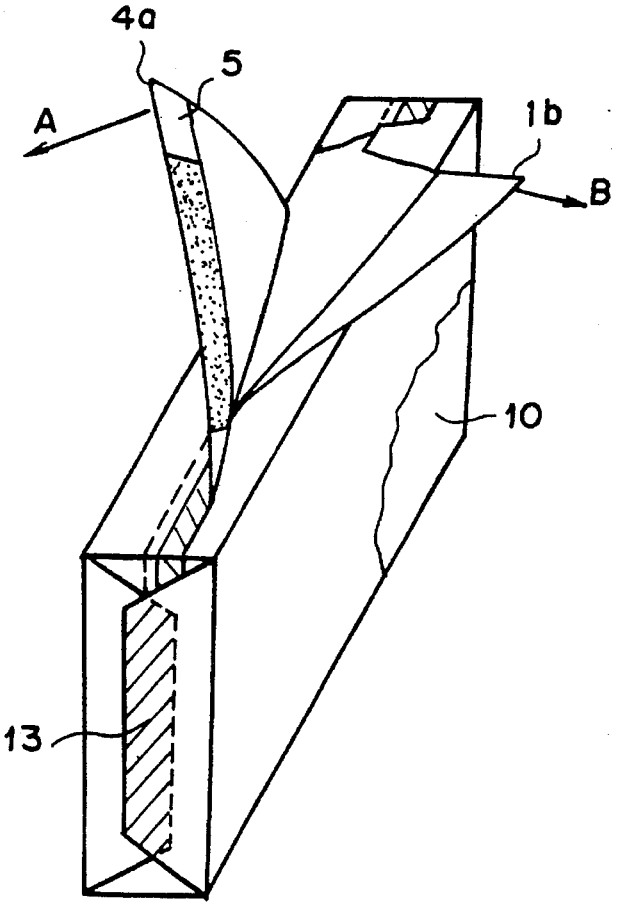
FIG. 9 is a schematic representation of the wrapped article shown in FIG. 7 when the upper film and a lower film of the body seal section are raised.

Also, in the fourth embodiment, an end 1*b* of the lower overlapping film of the wrapping film 1 in the vicinity of the notch 8 formed in the lower overlapping film is picked up and pulled in the direction of an arrow B, and the wrapping film 1 is peeled off from the notch 8 as shown in FIG. 9. This causes the wrapping film 1 to be widely opened in the opposite direction relative to the direction in which the upper overlapping film of the wrapping film 1 is opened, thereby leading to the wrapping film 1 being opened much wider. Thus, the film 1 can be peeled off so that substantially the whole of the wrapped article 10 may be considerably easily uncovered.

The slit 6 is created in the vicinity of the surface of the wrapped article 10 on which the side seal section 13 is formed, and hence a part of the wrapping film 1 remaining on the same surface where the side seal section 13 is formed can be very easily removed by pulling that remaining part of the film in such a direction that it is taken off.

In the fourth embodiment of this invention, although the notch 8 is formed in the lower overlapping film of the wrapping film 1, it may be formed, in the second and third embodiments, in the vicinity of the area on the lower overlapping film where the marginal line of the lower overlapping film and an imaginary continuation from the slit cross each other.

Figure 10:
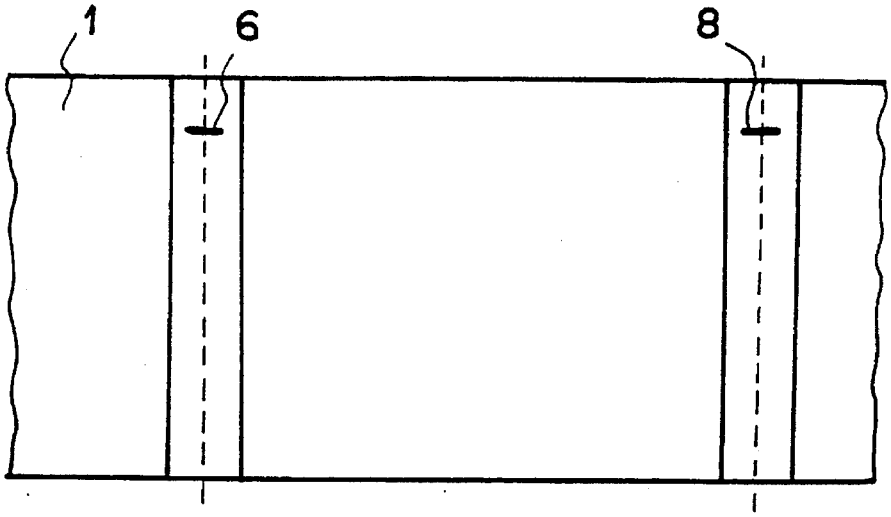
FIG. 10 is a schematic representation showing a slit and a notch formed in a wrapping film.
Figure 11:
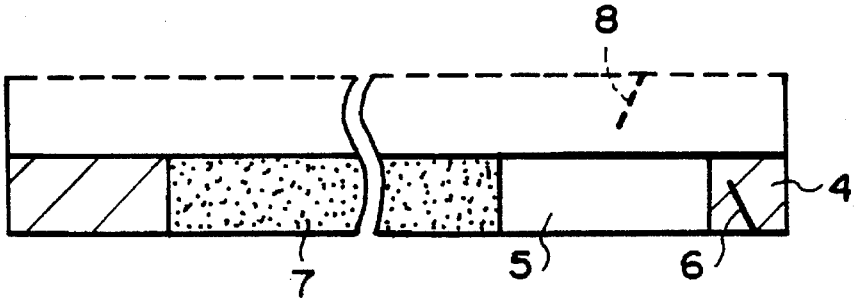
FIG. 11 is a schematic representation showing another embodiment of the slit and the notch formed on the wrapped article of the present invention.

The slit and notch of the wrapped article according to the fourth embodiment may be formed before or after the wrapping of the article to be wrapped 10. However, it is preferable to previously form the slit and the notch, thereby removing the risk of damage to the article by a cutting knife or the like. When the slit and the notch are previously created, the slit and the notch should be created so as to traverse broken lines of the wrapping film 1 along which the film can be separated as shown in FIG. 10. Thereby, the slit and the notch can be simultaneously formed.

Figure 12:
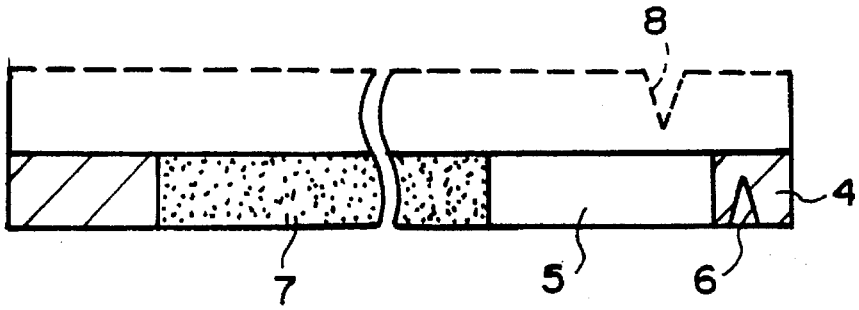
FIG. 12 is a schematic representation showing still another embodiment of the slit and the notch formed on the wrapped article of the present invention.

The slit and the notch are linearly formed in the previous embodiments, but the slit 6 and the notch 8 may be formed, for example, in a V-shape as shown in FIG. 12, thereby facilitating the picking up of the end of the film. The shape of the slit and notch can be applied to the second, third and fourth embodiments.

Figure 13:
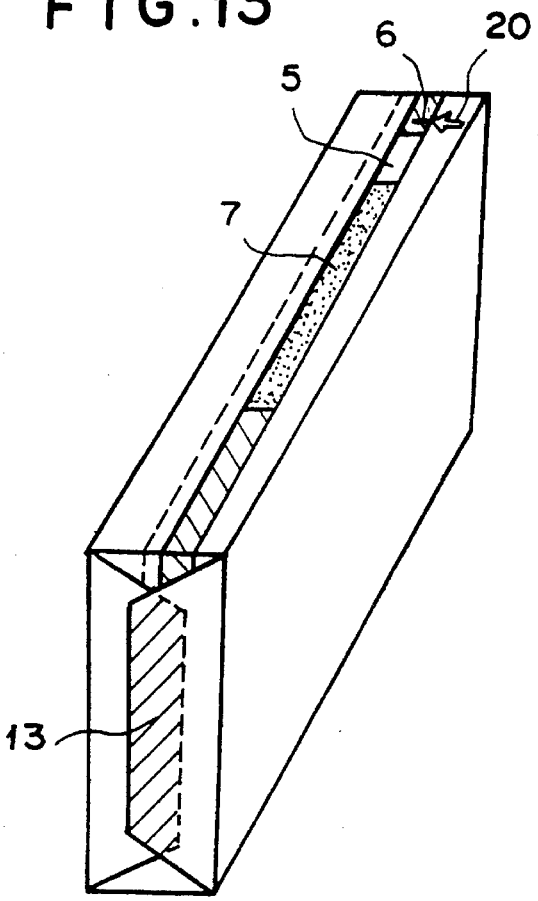
FIG. 13 is a schematic representation showing a wrapped article of the present invention in which an unbonded part and a slit are provided with a mark.

In order to make distinctive the position of the unbonded part and a tearing direction, the wrapping film may be provided with, for example, a mark 20 such as an arrow as shown in FIG. 13.

Moreover, to make the position of the unbonded part distinguished, the unbonded part may be made different in color from the other part.

Figure 14:
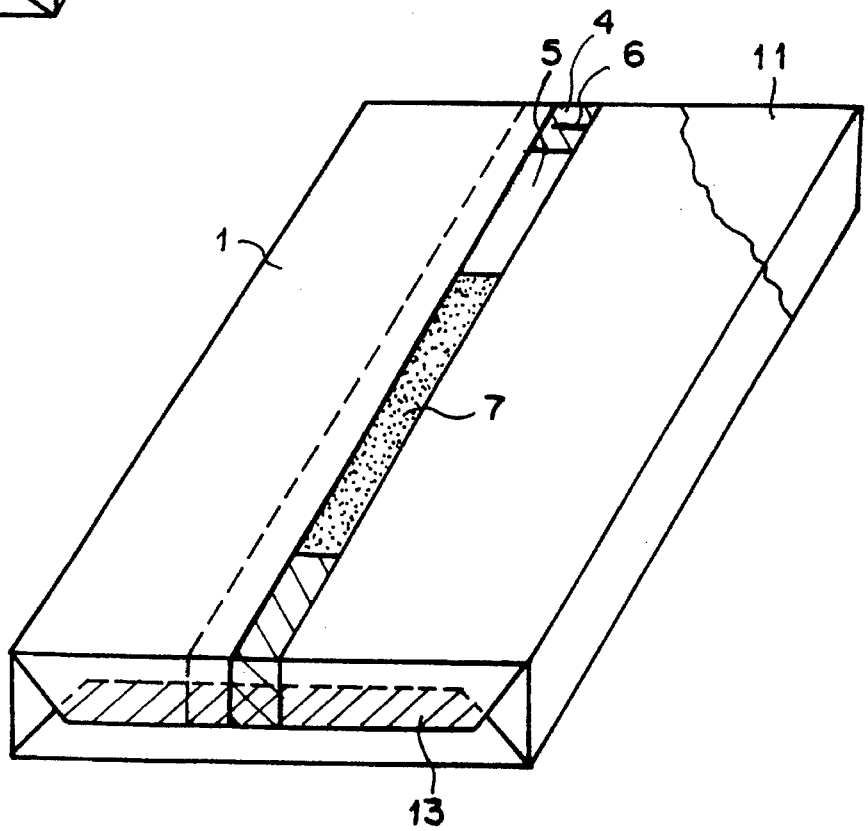
FIG. 14 is a schematic representation showing a wrapped article of the present invention when it is applied to a video cassette.

In the foregoing embodiments, the article to be wrapped is an audio cassette, but the wrapped article of this invention can be applied to, for example, a video cassette as shown in FIG. 14, in which the body seal section 4 is formed in a wider surface of the rectangular-parallelopiped cassette. Also, in the previous embodiment, an audio cassette and a video cassette or the like are used as the wrapped article, but the wrapped article is not limited to them. The wrapped article of this invention can be applied to articles in any shapes such as a sphere, a rectangular parallelopiped, a column, or a circular cone so long as it can be wrapped with a wrapping film.

In the previous embodiments, the weakly bonded part 7 is made by evenly mixing together the unbonded areas and the bonded areas. However, for example as shown in FIG. 16, the bonded areas (designated by black points) and the unbonded areas within the unbonded part 7 can be formed by making them exist at all areas.

As mentioned above, according to the wrapped article of the present invention, the unbonded part, the slit and the weakly bonded part are created in the body seal section without the use of a tearing tape, and hence the wrapping film can be widely torn up from the body seal section when the film is opened. Hence, the wrapping film is not completely separated into pieces while they still remain tightly attached to an article to be wrapped, which is common in opening the film by the use of a conventional tearing tape. Thus, the wrapping film can be peeled off in such a way that the article to be wrapped is easily uncovered by a single opening action. Moreover, the wrapped article of this invention yields several advantages; namely, a process for providing a tearing tape can be omitted from processing processes, and also a tearing tape itself becomes unnecessary, whereby material costs can be reduced.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A wrapped article comprising:

an article to be wrapped;

a wrapping film covering at least a portion of the outer surface of said article to be wrapped;

a body seal section having ends of the wrapping film overlapped with each other and bonded together;

an unbonded part formed along a periphery of an upper wrapping film of the wrapping film in such a way that the unbonded part is not adhered to a lower wrapping film of the wrapping film;

a slit formed in said body seal section of the upper wrapping film in the vicinity of the unbonded part at right angles or an inclined angle to the periphery of the upper wrapping film; and a weakly bonded part which is weakly bonded to the lower wrapping film and extends from the opposite side of the unbonded part relative to the slit to a predetermined length along the periphery of said upper wrapping film.

2. A wrapped article as defined in claim 1, wherein two opening sections, each including the unbonded part, the slit and the weakly bonded part, are arranged while the weakly bonded parts are inwardly opposite to each other.

3. A wrapped article as defined in claim 1, further comprising a notch that is further provided in the vicinity of the position where the marginal line of the lower wrapping film and an imaginary continuation from the slit cross each other.

4. A wrapped article as defined in claim 2, further comprising a notch that is further provided in the vicinity of the position where the marginal line of the lower wrapping film and an imaginary continuation from the slit cross each other.

5. A wrapped article as defined in claim 1, wherein the unbonded part is provided with a mark to make it distinctive.

6. A wrapped article as defined in claim 2, wherein the unbonded part is provided with a mark to make it distinctive.

7. A wrapped article as defined in claim 3, wherein the unbonded part is provided with a mark to make it distinctive.

8. A wrapped article as defined in claim 1, wherein a mark is provided in the unbonded part or in the vicinity of the unbonded part to indicate an opening direction.

9. A wrapped article as defined in claim 2, wherein a mark is provided in the unbonded part or in the vicinity of the unbonded part to indicate an opening direction.

10. A wrapped article as defined in claim 3, wherein a mark is provided in the unbonded part or in the vicinity of the unbonded part to indicate an opening direction.

11. A wrapped article as defined in claim 4, wherein a mark is provided in the unbonded part or in the vicinity of the unbonded part to indicate an opening direction.

12. The wrapped article in accordance with claim 1, wherein a length of said unbonded part along the periphery is set to be 10 to 50 mm.

13. The wrapped article in accordance with claim 1, wherein said slit is spaced 2–3 mm apart from an edge of said unbonded part that is nearest to the slit.

14. The wrapped article in accordance with claim 1, wherein said weakly bonded part is produced such that a rear surface of that area of said wrapping film which corresponds to said weakly bonded part is printed with an ink into half-tone dots or a matrix pattern.

15. The wrapped article in accordance with claim 1, wherein said weakly bonded part has varying bonding force according to a particular position of said weakly bonded part such that said bonding force becomes greater as the distance between the particular position and said unbonded part is increased.

16. The wrapped article in accordance with claim 1, wherein a length of said unbonded part along the periphery is set to be around 20 mm.

17. The wrapped article as defined in claim 1, wherein said slit is entirely contained within said body seal section.

* * * * *